US006575142B2

(12) United States Patent
Kurz et al.

(10) Patent No.: US 6,575,142 B2
(45) Date of Patent: Jun. 10, 2003

(54) HIGH-PRESSURE FUEL SYSTEM FOR INTERNAL COMBUSTION ENGINES

(75) Inventors: Michael Kurz, Gerlingen (DE); Kurt Frank, Schorndorf (DE); Juergen Hanneke, Stuttgart (DE); Marcus Haefele, Heidelberg (DE); Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/105,352

(22) Filed: Mar. 26, 2002

(65) Prior Publication Data

US 2002/0139869 A1 Oct. 3, 2002

(30) Foreign Application Priority Data

Mar. 28, 2001 (DE) ..... 101 15 214

(51) Int. Cl.[7] ..... F02M 37/04

(52) U.S. Cl. ..... 123/472; 123/470; 239/600; 239/533.11; 239/584

(58) Field of Search ..... 123/367, 472, 123/470; 251/367; 239/600, 86, 533.11, 532.2, 533.3, 583, 584

(56) References Cited

U.S. PATENT DOCUMENTS

| | | | | | |
|---|---|---|---|---|---|
| 4,007,880 | A | * | 2/1977 | Hans et al. | 239/585.5 |
| 5,247,918 | A | * | 9/1993 | Wakeman | 123/470 |
| 5,785,024 | A | * | 7/1998 | Takei et al. | 123/470 |
| 6,062,497 | A | * | 5/2000 | Bryan | 239/533.11 |
| 6,116,522 | A | * | 9/2000 | Kampichler | 239/533.2 |
| 6,269,795 | B1 | * | 8/2001 | Ripper et al. | 123/467 |
| 6,354,520 | B1 | * | 3/2002 | Yalcin | 239/533.11 |

* cited by examiner

*Primary Examiner*—Carl S. Miller
(74) *Attorney, Agent, or Firm*—Ronald E. Greigg

(57) ABSTRACT

A high-pressure fuel system for internal combustion engines, having a housing that contains two high-pressure bodies. The high-pressure bodies rest with contact surfaces at least indirectly against each other and are pressed against each other by means of a tensioning device. A supply conduit is embodied in the high-pressure bodies, which carries highly pressurized fuel and passes through the contact surfaces of the two high-pressure bodies. A sealing film is disposed between the two high-pressure bodies, which encompasses the passage of the high-pressure conduit and thus assures a favorable seal.

13 Claims, 3 Drawing Sheets

HIGH-PRESSURE FUEL SYSTEM FOR INTERNAL COMBUSTION ENGINES

BACKGROUND OF THE INVENTION

1. Field of the Invention

The invention is based on a high-pressure fuel system for internal combustion engines of the type disclosed in the patent application DE 198 27 628 A1.

2. Description of the Prior Art

A high-pressure fuel system of this kind, which in this application takes the form of a fuel injection valve, has a valve holding body and a valve body, which are pressed against each other by means of a tensioning nut. A supply conduit passes through the contact surface of the two bodies, through which highly pressurized fuel travels to the injection openings of the fuel injection valve. In order to assure the tightness of the supply conduit at it's passage through the contact surface of the two bodies, raised regions are embodied on the contact surfaces of the two bodies, in particular surrounding the passage of the supply conduit. With constant tightening moment on the tensioning nut, the surface pressure in this region is increased so that a better seal of the supply conduit is produced. In this connection, however, the known high-pressure fuel system has the disadvantage that the production of such raised regions is relatively complex and therefore cost-intensive. Moreover, the two bodies are made of a hard steel, which does not plastically deform when compressed by the tensioning nut, so that high demands must be placed on the surface quality of the raised regions in order to achieve a favorable seal.

SUMMARY OF THE INVENTION

The high-pressure fuel system according to the invention has the advantage over the prior art that a sealing film is disposed between the two high-pressure bodies, which encompasses the passage of the conduit through the contact surface and thus produces a seal in a simple and inexpensive way. The sealing film in this connection can be embodied so that in addition to the supply conduit, it also encompasses other passages of conduits and bores that are embodied in the high-pressure fuel system. The sealing film can be separately produced and, for example, stamped out of a corresponding plate so that it is simple and inexpensive to produce.

It is particularly advantageous to use the sealing film according to the invention in a fuel injection valve in which the sealing film is disposed between a valve holding body, which is embodied as a high-pressure body, and a valve body, which is likewise embodied as a high-pressure body. Particularly in injection systems that operate with a constantly prevailing pressure in the valve body, so-called common rail systems, a favorable tightness of the supply conduit, which extends in the valve holding body, through the sealing surface, to the valve body, can be achieved through simple means.

In advantageous embodiment of the subject of the invention, the sealing film is comprised of a metal. This metal is preferably soft in comparison to the steel of which the two high-pressure bodies are made. It has turned out to be particularly advantageous to use copper or soft iron as the material for the sealing film.

The sealing film preferably has a thickness in the range of a few $\mu$m up to a few hundred $\mu$m. As a result, the sealing action and the flow properties of the sealing film when the two high-pressure bodies are clamped against each other can be optimally matched to the desired tightness.

BRIEF DESCRIPTION OF THE DRAWINGS

An exemplary embodiment of the high-pressure fuel system according to the invention is described in detail herein below, with reference the drawings, in which.

DESCRIPTION OF THE PREFERRED EMBODIMENT

Figure 1:
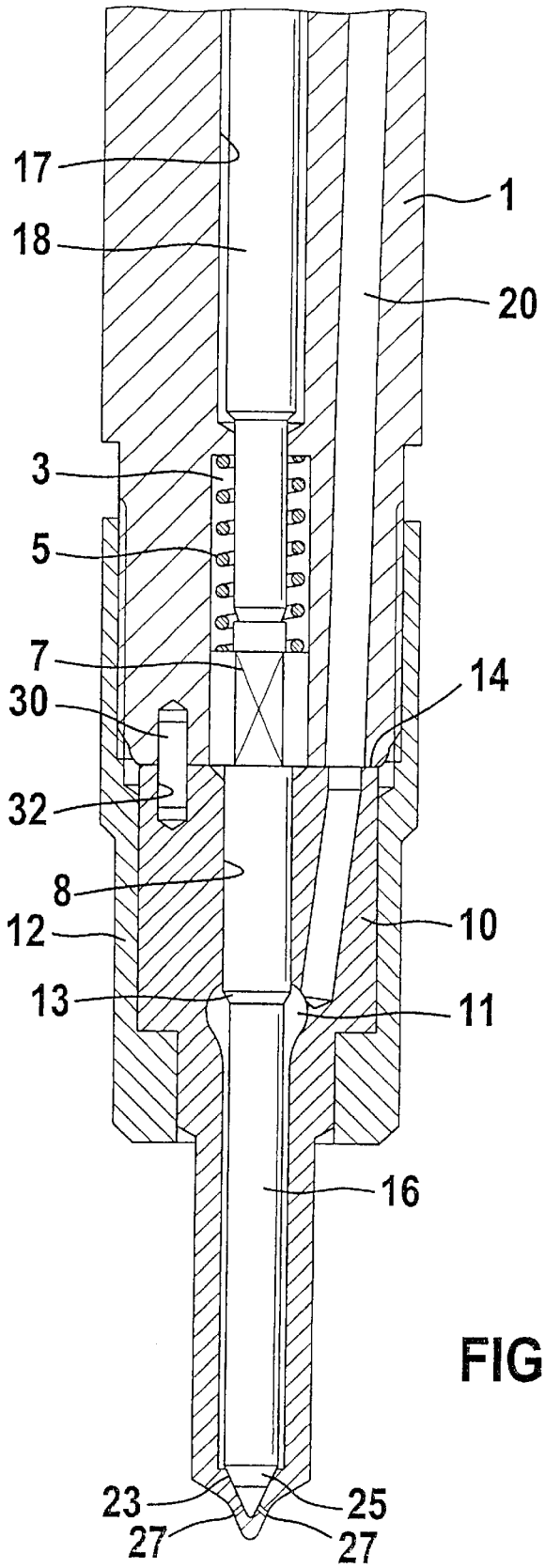
FIG. 1 is a longitudinal section through a high-pressure fuel system in the form of a fuel injection valve.

FIG. 1 shows a longitudinal section through an exemplary embodiment of a high-pressure fuel system according to the invention. In this instance, the high-pressure fuel system is a fuel injection valve, which has a housing that contains two high-pressure bodies, a valve holding body 1 and a valve body 10. In this connection, the valve body 10 is axially clamped by means of a tensioning nut 12 against the valve holding body 1 so that the two bodies 1,10 touch in a sealing surface 14. The valve body 10 contains a bore 8, in which a piston-shaped valve needle 16 is disposed in a longitudinally mobile fashion. On its end oriented toward the combustion chamber, the valve needle 16 has a valve sealing surface 25, which cooperates with a valve seat 23 embodied at the end of the bore 8 oriented toward the combustion chamber and thus, by means of its longitudinal movement, controls the opening of at least one injection opening 27, which is embodied in the valve seat 23. The valve needle 16 has a pressure shoulder 13, which is oriented toward the combustion chamber and is encompassed by a pressure chamber 11, which is constituted by a radial expansion of the bore 8 in the valve body 10. By means of a supply conduit 20, which is embodied in the valve body 10 and the valve holding body 1, the pressure chamber 11 communicates with a high-pressure fuel source, not shown in the drawing, so that the pressure chamber 11 can be filled with highly pressurized fuel.

At its end oriented away from the combustion chamber, the valve needle 16 transitions into a thrust bolt 7, which is disposed in a longitudinally mobile fashion, coaxial to the valve needle 16, in a spring chamber 3 embodied in the valve holding body 1. The spring chamber 3 contains means for producing a closing force on the valve needle 16, which are in the form of a closing spring 5 in this instance, which is disposed between the thrust bolt 7 and the end of the spring chamber 3 remote from the combustion chamber with a compressive initial stress so that the closing spring 5 acts on the valve needle 16 in the closing direction. At its end remote from the combustion chamber, the thrust bolt 7 transitions into a valve piston 18, which is disposed in a longitudinally mobile fashion in a piston bore 17 embodied in the valve holding body 1 and can be used to exert a closing force on the valve needle 16 by means of a device that is not shown in the drawing. Depending on the magnitude of this closing force, the valve needle 16 is moved by the pressure in the pressure chamber 11 and the attendant hydraulic force on the pressure shoulder 13 in the opening direction, i.e. away from the combustion chamber, or is pressed by the closing force of the valve piston 18, with the valve sealing surface 25 against the valve seat 23 so that the injection openings 27 there are closed.

Figure 2:
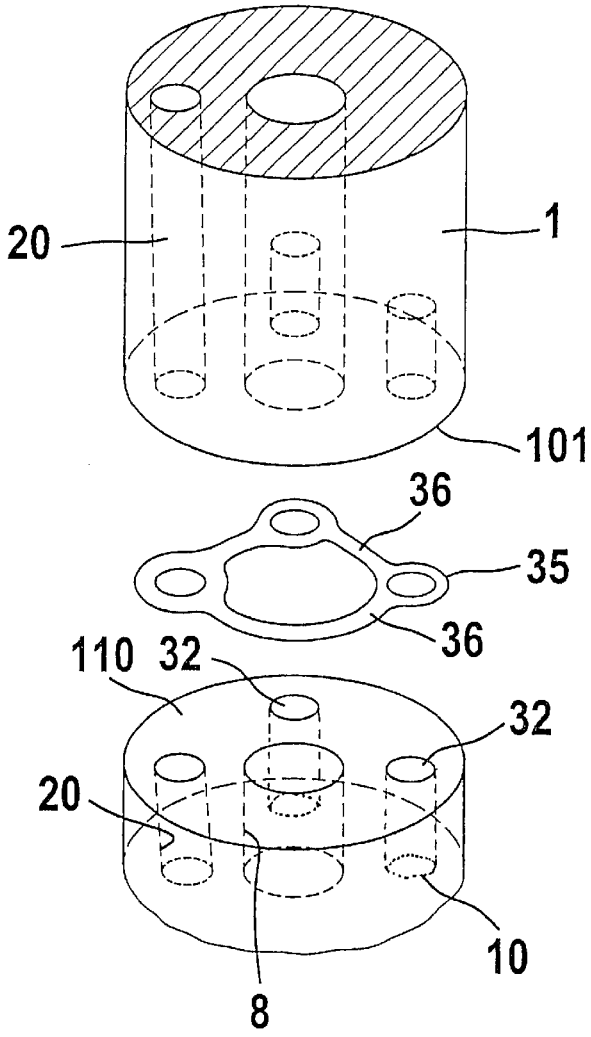
FIG. 2 shows an enlarged, exploded view in the vicinity of the sealing surface between the valve holding body and the valve body.
Figure 3:
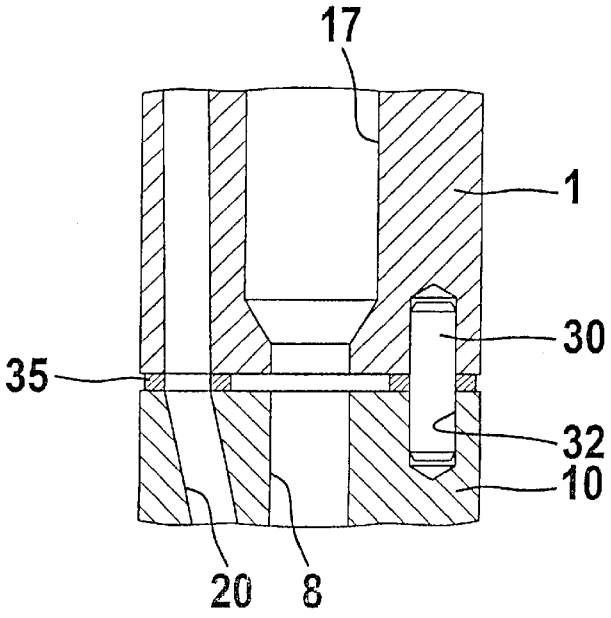
FIG. 3 shows an enlargement of FIG. 1 in the vicinity of the sealing film.

The valve holding body 1, which is embodied as a high-pressure body, rests with a contact surface 101 against contact surface 110 embodied on the valve body 10. FIG. 2 shows the region of the contact surfaces of the valve holding body 1 and valve body 10 in an exploded view. Between the contact surfaces 101 and 110, a sealing film 35 is provided, which is embodied so that it encompasses the passages of the supply conduit 20 and of centering pin bores 32 through the sealing surface 14. Centering pins 30 are disposed in the centering pin bores 32 and protrude into both the valve holding body 1 and the valve body 10, thus permitting a precise alignment of the two high-pressure bodies in relation to each other. FIG. 2 shows one possible embodiment of the sealing film 35. In the exemplary embodiment shown here, in which two centering pin bores 32 are embodied in the valve body 10 in addition to the supply conduit 20 and the bore 8, the sealing film 35 includes three annular disk-shaped regions, which encompass the supply conduit 20 and the two centering pin bores 32 and are connected to one another by means of connecting pieces 36. This produces a coherent sealing film 35, which with already-mounted is centering pins 30 in the valve body 10, can be easily positioned by means of these pins and thus encompasses all passages through the contact surfaces 101 and 110 without further adjustment. FIG. 3 is an enlargement of FIG. 1 in the vicinity of the contact surfaces, where the sealing film 35 shown here is enlarged in thickness for the sake of clarity. It is clear that the sealing film 35 encompasses both the passage of the supply conduit 20 and the passage of the centering pin bores 32, without protruding into the respective passages.

Figure 4:
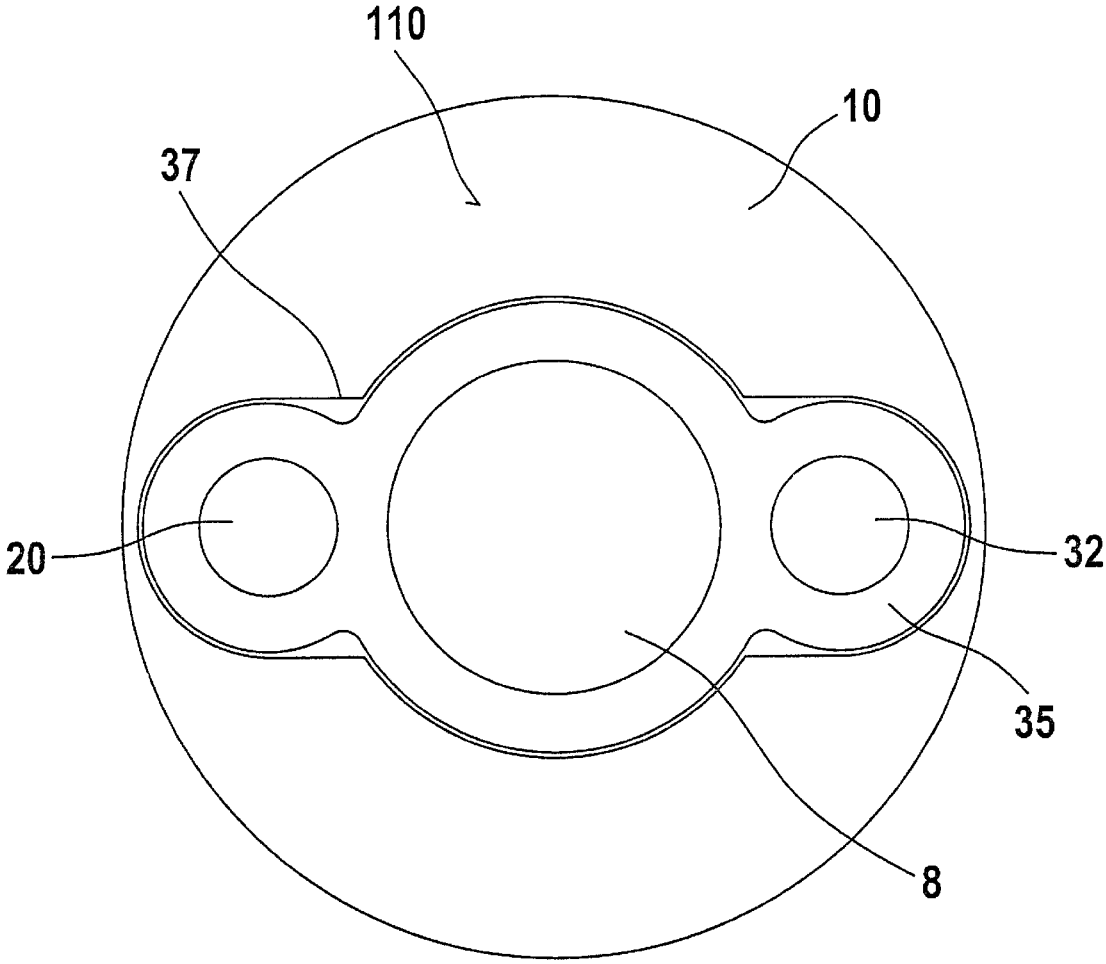
FIG. 4 shows a top view of the contact surface of the valve body, with the sealing film inserted into it.

FIG. 4 shows another exemplary embodiment of a sealing film 35 according to the invention. In this instance, a top view of the valve body 10 is shown, where the valve body 10 shown here has only one centering pin bore the 32 and in addition to this, has only the bore 8 and the supply conduit 20. Since the supply conduit 20 and the centering pin bore 32 have the same diameter in this case and are disposed opposite each other in relation to the center point of the circular contact surface 110, the sealing film 35 can be embodied as mirror-image symmetrical so that it cannot be incorrectly installed during assembly of the fuel injection valve. The contact surface 110 of the valve body 10 is provided with a recess 37 into which the sealing film 35 is inserted. In this connection, the recess 37 is embodied so that the sealing film 35 cannot slide laterally against the contact surface 110. The recess 37, however, is not so deep that it can accommodate the full depth of the sealing film 35; as a result, the sealing film 35 protrudes from the contact surface 110. Consequently, when the fuel injection valve is assembled, the contact surface 101 of the valve holding body 1 contacts the sealing film 35 and not the contact surface 110.

The sealing film 35 can be made of various materials. These include, for example, steel that can have a greater or lesser hardness than the steel from which the high-pressure bodies are produced. Moreover, the sealing film 35 can also be made of a metal that is soft in comparison to steel, for example copper or soft iron. Such a soft metal makes it possible for the material to flow when the tensioning nut is tightened so that smaller irregularities in the contact surfaces or dirt particles do not impair the tightness. The thickness of the sealing film 35 can be adapted to the corresponding demands of the fuel injection valve or the otherwise-embodied high-pressure fuel system. It can have a thickness of only a few $\mu$m or even a few tenths of a millimeter; preferably, the sealing foil 35 has a thickness of 5 to 500 $\mu$m. Depending on the thickness of the sealing foil 35, hardness of the material, and tightening moment of the tensioning nut, a more or less powerful flow of the sealing film 35 is produced between the two high-pressure bodies. In this connection, care must be taken that the material of the sealing foil 35 does not flow into the supply conduit 20 and lead to a constriction of the flow cross-section there. In addition, it is also possible to make the sealing foil 35 out of a plastic, which is not dissolved by the fuel and, through its softness, assures a favorable seal with a small amount of contact pressure.

In addition to the forms of the sealing film 35 shown in FIGS. 2, 3, and 4, it is also possible for the sealing film 35 to have other shapes, depending on the number of passages of conduits or bores through the contact surfaces of the high-pressure bodies. In this connection, however, care must always be taken to assure that the sealing foil 35 encompasses the conduits in the vicinity of the passage in an annular, disk-shaped fashion so that a favorable seal is always produced there. In addition to the example of a high-pressure fuel system in the form of a fuel injection valve shown in the drawings, a sealing film according to the invention can also be used in other high-pressure fuel systems in which the passage of a high-pressure fuel conduit through the sealing surfaces of two high-pressure bodies needs to be sealed. Examples of such high-pressure fuel systems include high-pressure fuel pumps, line seals, or unit injectors, and any connections of high-pressure lines to high-pressure bodies.

In addition to the sealing film 35 shown in the drawings, the sealing foil 35 can also be produced not as a separate piece, but formed directly onto a contact surface of a high-pressure body. This can be achieved, for example, by a corresponding layer that is deposited onto the contact surface electrolytically, galvanically, or with a photo-technical process so that the passages of high pressure-carrying conduits and the other bores are encompassed by a raised surface.

What is claimed is:

1. A high-pressure fuel system for internal combustion engines, comprising a housing that contains two high-pressure bodies (1; 10), which rest with contact surfaces (101; 110) at least indirectly against each other and are pressed against each other by means of a tensioning device, a supply conduit (20) embodied in the high-pressure bodies (1; 10), which conduit carries highly pressurized fuel and passes through the contact surfaces (101; 110) of the two high-pressure bodies (1;10), and a sealing film (35) disposed between the two high-pressure bodies (1; 10), which encompasses at least the passage of the high-pressure conduit (20) through the contact surfaces (101; 110), wherein the sealing film (35) has a thickness in the range of 5 to 500 $\mu$m.

2. The high-pressure fuel system according to claim 1 wherein the sealing film (35) is made of metal.

3. The high-pressure fuel system according to claim 2 wherein the high-pressure bodies (1; 10) are comprised of metal and that the metal of the sealing film (35) is softer than the metal of the high-pressure bodies (1; 10).

4. The high-pressure fuel system according to claim 3 wherein the metal of the sealing film is copper.

5. The high-pressure fuel system according to claim 3 wherein the metal of the sealing film is soft iron.

6. The high-pressure fuel system according to claim 1 wherein the sealing film covers only part of the contact surfaces (101; 110) of the high-pressure bodies (1; 10).

7. The high-pressure fuel system according to claim 6 wherein the sealing film (35) encompasses the passage of the high-pressure conduit (20) and possibly other passages in an annular, disk-shaped fashion.

8. The high-pressure fuel system according to claim 7 wherein the annular, disk-shaped regions of the sealing film (35) are connected to each other by means of connecting pieces (36).

9. A high-pressure fuel system for internal combustion engines, comprising a housing that contains two high-pressure bodies (1; 10), which rest with contact surfaces (101; 110) at least indirectly against each other and are pressed against each other by means of a tensioning device, a supply conduit (20) embodied in the high-pressure bodies (1; 10), which conduit carries highly pressurized fuel and passes through the contact surfaces (101; 110) of the two high-pressure bodies (1;10), and a sealing film (35) disposed between the two high-pressure bodies (1; 10), which encompasses at least the passage of the high-pressure conduit (20) through the contact surfaces (101; 110), further comprising a recess (37) formed in one of the contact surfaces (101; 110), and wherein the sealing film (35) is inserted into said recess (37).

10. The high-pressure fuel system according to claim 1 wherein the sealing film (35) is embodied by being formed onto one of the contact surfaces (101; 110) of a high-pressure body (1; 110).

11. The high-pressure fuel system according to claim 1 wherein the high-pressure fuel system is a fuel injection valve.

12. The high-pressure fuel system according to claim 11 wherein one of the high-pressure bodies is a valve body (10), in which a valve needle (16) is disposed in a longitudinally mobile fashion.

13. The high-pressure fuel system according to claim 12 wherein the other high-pressure body is a valve holding body (1), which contains means that exert a closing force on the valve needle (16).

* * * * *